US007531966B2

(12) United States Patent
Hwang et al.

(10) Patent No.: US 7,531,966 B2
(45) Date of Patent: May 12, 2009

(54) LAMP BALLAST CIRCUIT

(75) Inventors: Jong-Tae Hwang, Bucheon (KR); Gye-Hyun Cho, Bucheon (KR); Jin-Sung Kim, Bucheon (KR); Jin-Ho Choi, Bucheon (KR)

(73) Assignee: Fairchild Korea Semiconductor, Ltd., Bucheon (KR)

( * ) Notice: Subject to any disclaimer, the term of this patent is extended or adjusted under 35 U.S.C. 154(b) by 42 days.

(21) Appl. No.: 11/805,931

(22) Filed: May 25, 2007

(65) Prior Publication Data

US 2008/0272707 A1 Nov. 6, 2008

(30) Foreign Application Priority Data

May 2, 2007 (KR) ..... 10-2007-0042622

(51) Int. Cl.
*H05B 37/02* (2006.01)

(52) U.S. Cl. ..... 315/224; 315/209 R; 315/291; 315/307

(58) Field of Classification Search ..... 315/209 R, 315/247, 276, 291, 307, 224–226, 244, 308, 315/360

See application file for complete search history.

(56) References Cited

U.S. PATENT DOCUMENTS

| | | | | |
|---|---|---|---|---|
| 4,177,393 | A | 12/1979 | Forster | |
| 4,184,106 | A | 1/1980 | Schaas | |
| 5,331,253 | A * | 7/1994 | Counts | 315/209 R |
| 5,828,187 | A * | 10/1998 | Fischer | 315/291 |
| 6,218,891 | B1 * | 4/2001 | Lotfi et al. | 327/431 |
| 6,429,603 | B1 * | 8/2002 | Tsugita et al. | 315/224 |
| 6,831,847 | B2 * | 12/2004 | Perry | 363/21.06 |

* cited by examiner

*Primary Examiner*—Douglas W Owens
*Assistant Examiner*—Jimmy T Vu
(74) *Attorney, Agent, or Firm*—Sidley Austin LLP

(57) ABSTRACT

In one embodiment, a power switch driving circuit is provided for a fluorescent lamp ballast. The circuit includes a first power switch driven by a first driver. A controller has a first output terminal for outputting a control signal for controlling the first driver. The first driver includes a first capacitor having a first terminal electrically connected to a control electrode of the first power switch and a second terminal electrically connected to the first output terminal.

19 Claims, 4 Drawing Sheets

800

LAMP BALLAST CIRCUIT

CROSS-REFERENCE TO RELATED PATENT APPLICATIONS AND CLAIM OF PRIORITY

This application claims priority to and the benefit of Korean Patent Application No. 10-2007-0042622 filed in the Korean Intellectual Property Office on May 2, 2007, the entire content of which is incorporated herein by reference.

BACKGROUND OF THE INVENTION

1. Field of the Invention

The present invention relates to ballast control for a fluorescent lamp and, more particularly, to a lamp ballast circuit and method.

2. Description of the Related Art

A semiconductor device for ballast control of a fluorescent lamp is typically designed to drive a power switch implemented as a metal-oxide semiconductor field-effect transistor (MOSFET). A MOSFET is turned on (or driven) by the application of an appropriate voltage at its gate electrode. When the MOSFET element is turned on, no current flows to the gate electrode and no power is consumed. In order to drive a bipolar junction transistor (BJT), however, not only must an appropriate voltage be applied between the base and the emitter of the BJT to turn it one, but a continuous base driving current is needed to maintain the on state after the BJT is turned on. Accordingly, a driving circuit for a BJT-implemented power element must supply a base current while also providing the necessary voltage difference between the base and emitter to turn on the BJT. Therefore, with a BJT-implemented power element, more power is consumed and more heat is generated by the driving circuit than would be the case for a MOSFET-implemented power element.

But a BJT-implemented power element is cheaper than a MOSFET-implemented power element. Thus, the cost of a fluorescent lamp ballast can be reduced if an efficient method for driving a BJT-implemented power element is provided.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a power element driving circuit having advantages of using a bipolar junction transistor (BJT) as a power switch, but reducing power consumption and heat generation.

According to one embodiment of the present invention, a lamp ballast circuit includes a first power switch. First driver circuitry controls the first power switch. A controller includes a first output terminal for outputting a control signal to the first driver circuitry. The first driver circuitry includes a first capacitor having a first terminal electrically connected to a control electrode of the first power switch and a second terminal electrically connected to the first output terminal. In one implementation, the first power switch can be a BJT, and the controller can be one that is designed for use with a metal-oxide semiconductor field-effect transistor (MOSFET) as a power switch.

According to another embodiment of the present invention, a lamp ballast circuit includes a power switch. A driver circuitry generates a drive current signal for controlling the switching operation of the power switch. A controller generates a control signal that has a level for turning on the power switch for a first period. The controller provides the control signal to the driver circuitry. The drive current signal reaches a maximum value at a beginning of the first period, and thereafter decreases over the remainder of the first period. In one implementation, the first power switch can be a BJT, and the controller can be one that is designed for use with a MOSFET as a power switch.

According to another embodiment of the present invention, a lamp ballast circuit comprises a first power switch operable to be turned on and off for providing power to a lamp. The first power switch has a control electrode. A first driver circuitry drives the first power switch with a current provided at the control electrode. A controller includes a first output terminal for outputting a control signal to the first driver circuitry to control the driving of the first power switch. The first driver circuitry includes a first capacitor having a first terminal electrically connected to the control electrode of the first power switch and a second terminal electrically connected to the first output terminal. The first capacitor causes a magnitude of the current provided at the control electrode to decrease over a period following the turn on of the first power switch.

Important technical advantages of the present invention are readily apparent to one skilled in the art from the following figures, descriptions, and claims.

BRIEF DESCRIPTION OF THE DRAWINGS

For a more complete understanding of the present invention and for further features and advantages, reference is now made to the following description taken in conjunction with the accompanying drawings.

DETAILED DESCRIPTION

Figure 1:
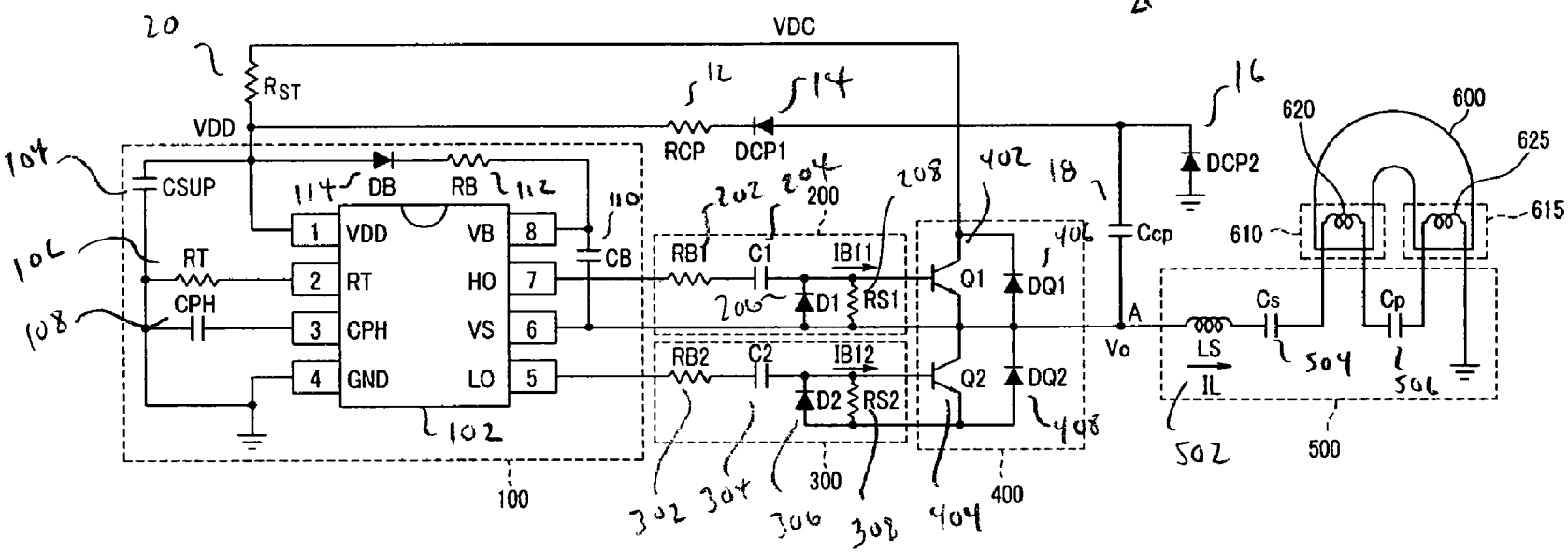
FIG. 1 is a schematic diagram of an exemplary implementation for a lamp ballast circuit, according to an embodiment of the present invention.

In the following detailed description, certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Throughout this specification and the claims that follow, when it is described that an element is "coupled" or "connected" to another element, the element may be directly coupled or connected to the other element or electrically coupled or connected to the other element through one or more other elements. In addition, unless explicitly described to the contrary, the word "comprise" and variations such as "comprises" or "comprising," will be understood to imply the inclusion of stated elements but not the exclusion of any other elements.

FIG. 1 is a schematic diagram of an exemplary implementation for a lamp ballast circuit 10, according to an embodiment of the present invention. In general, lamp ballast circuit 10 provides or supports ballast control for a fluorescent lamp 600. Lamp ballast circuit 10 provides an output voltage Vo at an output terminal. As shown in FIG. 1, the lamp ballast circuit 10 includes a controller block 100, an upper driver block 200, a lower driver block 300, a switch block 400, and a lamp driver block 500.

All or a portion of lamp ballast circuit 10 can be implemented on a single or multiple semiconductor dies (commonly referred to as a "chip") or discrete components. Each die is a monolithic structure formed from, for example, silicon or other suitable material. For implementations using multiple dies or components, the dies and components can be assembled on a printed circuit board (PCB) having various traces for conveying signals therebetween. In one embodiment, for example, at least a portion of controller block 100 is implemented on its own, separate chip or die, and the remaining elements of power converter system 10 are implemented as discrete components.

The switch block 400 includes an upper power switch (Q1) 402 and a lower power switch (Q2) 404, which can be connected in a half-bridge arrangement. Each of upper and lower power switches 402 and 404 is implemented as a bipolar junction transistor (BJT), for example, an n-channel type. The collector of the upper power switch 402 is connected to the power VDC so that the DC voltage is provided thereto. The emitter of the lower power switch 404 is grounded. The upper power switch 402 and lower power switch 404 are alternately turned on (i.e., the two switches are not turned on at the same time). The upper power switch 402 is turned on and off to ramp up and down the current IL of an inductor 502 in lamp driver block 500, thus controlling or regulating the output voltage Vo at the output terminal. The lower power switch 404 may provide or support synchronous rectification. For synchronous rectification, the lower power switch 404 is turned off during the charge cycle for inductor 502, and turned on as inductor 502 discharges into the load (lamp 600). The upper power switch 402 and the lower power switch 404 are connected to a diode (DQ1) 406 and a diode (DQ2) 408, respectively. The diodes 406 and 408 may function to clamp the output voltage Vo to a certain (e.g., predetermined) range.

Controller block 100, upper driver block 200, and lower driver block 300 provide control and drive signals for turning on and off the upper and lower power switches 402 and 404 of switch block 400.

The controller block 100 may comprise a control device 102, a capacitor (Csup) 104, resistors (Rt) 106 and (Rb) 112, capacitors (Cph) 108 and (Cb) 110, and a diode (Db) 114. Control device 102 can be implemented, for example, as an integrated circuit (IC). In some embodiments, the control device 102 can be a controller which is designed for use with MOSFET-implemented power elements. In some embodiments, the control device 102 can be implemented as an integrated circuit (IC) device.

Power VDD for the controller block 100 (and control device 102 in particular) is provided in part by a resistor (RCP) 12, a diode (DCP1) 14, a diode (DCP2) 16, and a capacitor (Ccp) 18. A first terminal of a resistor 12 is connected to a cathode of a diode 14. An anode of the diode 14 is connected a first terminal of a capacitor 18 and a cathode of diode 16.

A DC power VDC, which may be generated from an AC power, is provided in the lamp ballast circuit 10. In general, the voltage of the power VDC can be several hundred volts. In one embodiment, power VDC has a value of 310V when it is generated by using 220V AC. Because of the magnitude of power VDC, it cannot be directly provided to controller block 100 as power VDD. Instead, a resistor (RST) 20 can be connected between the power VDC and controller block 100. Resistor 20 increases power consumption in lamp ballast circuit 10 as current is supplied to controller 100. To solve or mitigate the power consumption, in one embodiment, the resistor 20 is set a current with a value of several hundred uA flows to the controller block 100.

When the lamp ballast circuit 10 is in operation, the value of the output voltage Vo moves between the power VDC voltage and the ground voltage GND. The output voltage Vo charges capacitor 104 of the controller block 100 through the capacitor 18 while increasing from the ground voltage GND to the power VDC voltage to thus provide the power VDD to the control device 102 of controller block 100. When the voltage Vo is reduced from the power VDC voltage to the ground voltage GND, the discharge of the capacitor 104 is suppressed by diode 14. The capacitor 18 is discharged by through diode 16, in accordance with known techniques for charge pumping.

Control device 102 has a plurality of terminals or pins for input and/or output. In this embodiment, eight pins (1 to 8) are provided. The present invention, however, is not so limited; in other embodiments, more or less pins can be provided for control device 102. Pin 1 of control device 102 is connected to the receive the power VDD that supplies power to the controller 100 when it is driven. Pin 2 is connected to the resistor 102, which may function to set an oscillator frequency for the control device 102 (as explained below in more detail). Pin 3 of the controller 100 is connected to the capacitor 108, which may function to set an initial period for driving lamp 600 at a high frequency (explained below). Pin 4 is connected to the ground GND. The capacitor 104 is connected between the power VDD and the ground GND to maintain the potential between VDD and GND without a steep change. Pin 8 is connected to a first terminal of a capacitor 110, and receives a voltage VB of the first terminal of the capacitor 110. Pin 6 is connected to a second terminal of the capacitor 110, and receives a voltage VS of the second terminal of the capacitor 110. At Pin 7, control device 102 outputs a signal HO for controlling the upper power switch 402. The value of signal HO may swing between the voltage VB and the voltage VS. At Pin 5, control device 102 outputs a signal LO for controlling the lower power switch 404. The value of signal LO swings between the voltage VDD and the ground voltage GND. The switching operation of the upper power switch 402 and the lower power switch 404 is controlled according to the signals HO and LO.

In one embodiment, the resistor 102 may determined or set the switching frequency of an upper power switch (Q1) 402 and a lower power switch (Q2) 404 of the switch block 400. The controller 100 includes an oscillator and generates an oscillation frequency that can be varied by changing the resistance value of the resistor 102.

For efficiency, a high switching frequency is used to drive the lamp 600 in an initial period, and then the switching frequency is reduced after a predetermined time. The capacitor 108 sets the period during which the lamp 600 is driven with high frequency. That is, the capacitor CPH is used as a timer. In one embodiment, in order to determine the period for high frequency driving, a predetermined current is provided to the capacitor 108 and the time required for the voltage to reach a predetermined value is measured. When the capacitance value of the capacitor CPH is large, the period for high frequency driving is increased. When the capacitance value of the capacitor CPH is small, the period for high frequency driving is decreased.

Diode 114 and resistor 112 are coupled between the power VDD and capacitor 110. Current flows from power VDD through diode 114 and resistor 112 to charge capacitor 110 in order to provide the voltage VB.

Upper driver block 200 and lower driver block 300 receive the control signals HO and LO, respectively, from control block 100. Upper driver block 200 and lower driver block 300 are used to drive the upper power switch 402 and the lower power switch 404, respectively. Upper driver block 200 provides a current IB11 to the base of upper power switch 402 for driving thereof. Lower driver block 300 provides a current IB12 to the base of lower power switch 404 for driving thereof.

In one embodiment, as depicted, the upper driver block 200 includes a resistor (RB1) 202, a capacitor (C1) 204, a diode (D1) 206, and a resistor (RS1) 208. The control signal HO is applied to the first terminal of the resistor 202. A second terminal of the resistor 202 is connected to a first terminal of the capacitor 204. A cathode of the diode 206 and a first terminal of the resistor 208 are connected to a second terminal of the capacitor 204 and a base of the upper power switch 402. An anode of the diode 206 and a second terminal of the resistor 208 are connected to the pin 6 of control device 102. The resistor 202 reduces the current supplied to the base of the upper power switch 402, and the resistor 208 is used to turn off the upper power switch 402 when no current is provided from pin 7 or when the controller block 100 is turned off. The capacitor 204 provides a large flow of current to the base of the upper power switch 402 when it is turned on. As a predetermined voltage is charged in capacitor 204 over time, the current flowing from capacitor 204 to the base of upper power switch 402 is reduced. The diode 206 is connected to capacitor 204 to more stably maintain the turn-off state of the upper power switch 402 when it is supposed to be turned off. That is, the voltage charged in the capacitor 204 is applied to the base and the emitter of the upper power switch 402 in the opposite direction during the turn-off period. In this instance, the diode 206 functions as a clamp so that the voltage at the emitter may be greater than that at the base by 0.7V in order to protect the base and the emitter of the upper power switch 402. In other words, the diode 206 maintains the voltage at the base of upper power switch 402 to be less than the voltage at its emitter, and thus maintains the turn-off state of the upper power switch 402. In this instance, 0.7V is the voltage level corresponding to the threshold voltage of the diode 206, but the embodiment of the present invention is not limited thereto.

In one embodiment, as depicted, the lower driver block 300 includes a resistor (RB2) 302, a capacitor (C2) 304, a diode (D2) 306, and a resistor (RS2) 308. The control signal LO is applied to a first terminal of the resistor 302. A second terminal of the resistor 302 is connected to a first terminal of the capacitor 304. A cathode of the diode 306 and a first terminal of the resistor 308 are connected to a second terminal of the capacitor 304 and a base electrode of the lower power switch 404. An anode of the diode 306 and a second terminal of the resistor 308 are connected to the pin 5 of control device 102. The resistor 302, the capacitor 304, the diode 306, and the resistor 308 of the lower driver block 300 perform the substantially the same operations as those of the resistor 202, the capacitor 204, the diode 206, and the resistor 208 of the upper driver block 200.

The lamp driver block 500 includes inductor 502, and capacitors (Cs) 504 and (Cp) 506. The voltage Vo, which is the voltage at the node where upper power switch 402 and lower power switch 404 are connected (i.e., the switching node), is applied to a first terminal of the inductor 502. When the upper power switch 402 is turned on, the voltage Vo approaches the voltage VDC, and when the lower power switch Q2 is turned on, the voltage Vo approaches the ground voltage. When a lamp 600 is turned on, to thus enter the stabilized condition, the resonance current IL flowing through the inductor 502 causes the voltage Vo to increase or approach the voltage VDC before the upper power switch 402 is turned on. Likewise, the resonance current IL flowing through the inductor 502 causes the voltage Vo to decrease or approach the ground voltage before the lower power switch 404 is turned on. This switching technique is known generally as zero voltage switching (ZVS).

The lamp 600 includes two terminals 610 and 615, each of which includes two ports. The terminals 610 and 615 include filaments 620 and 625 for connecting the respective ports. A first terminal and a second terminal of the capacitor 506 in the lamp driver block 500 are respectively connected to the terminals 610 and 615, and are connected to the lamp 600 in parallel. A first terminal of the capacitor 504 in he lamp driver block 500 is connected to the terminal 610, and a second terminal of the inductor 502 in the lamp driver block 500 is connected to a second terminal of the capacitor 504. Connected in the way described above and also shown in FIG. 1, the lamp 600, the inductor 502, the capacitor 504, and the capacitor 506 form a resonance tank circuit. The resonance tank circuit is driven by the switching of the upper power switch 402 and the lower power switch 404.

Operations of various elements, components, or blocks of lamp ballast circuit 10 will now be described with reference to FIGS. 2 through 6.

Figure 2:
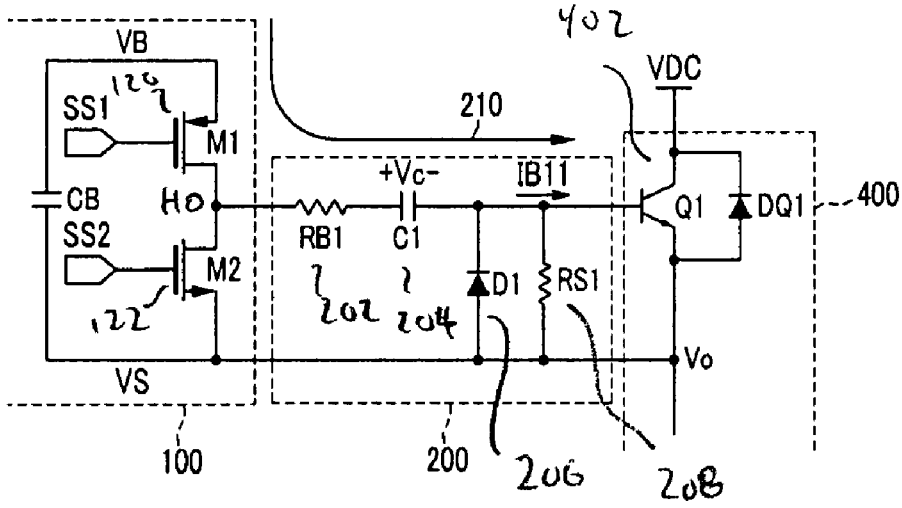
FIG. 2 shows an operation of a portion of the lamp ballast circuit when an upper power switch is turned on, according to an embodiment of the present invention.

FIG. 2 shows an operation of a portion of the lamp ballast circuit 10 when the upper power switch 402 is turned on, according to an embodiment of the present invention. Upper power switch 402 is turned on by upper driver block 200 in response to control signal HO from control device 102 of controller block 100.

In some embodiments, the control device 102 can be a controller which is designed for use with MOSFET-implemented power elements. As shown, the control device 102 of the controller block 100 may include a first transistor (M1) 120 and a second transistor (M2) 122, each of which can be implemented as a metal-oxide semiconductor field-effect transistor (MOSFET). First and second transistors 120 and 122 are coupled together at pin 7 of the controller block 100, at which the control signal HO is provided. The voltage VB is applied to a source electrode of the transistor 120, and a control signal SS1 is applied to a gate electrode thereof. The voltage VS is applied to a source electrode of the transistor 122, and a control signal SS2 is applied to a gate electrode thereof. The control signals SS1 and SS2 are generated by the controller 100 and used to control switching of the upper power switch 402 and the lower power switch 404, so that the controller 100 may drive the lamp 600. In one embodiment, the control signals SS1 and SS2 may be clock signals having a predetermined cycle.

In general, when the control signals SS1 and SS2 are both high, the transistor 122 is turned on and the transistor 120 is turned off. Thus, the signal HO output from controller block 100 at pin 7 has low level. When the control signals SS1 and SS2 are both low, the transistor 120 is turned on and the transistor 122 is turned off. Thus, signal HO output from pin 7 has a high-level.

FIG. 2 illustrates the case in which the control signals SS1 and SS2 are both low-level signals. Thus, the transistor 120 is turned on, the transistor 122 is turned off, and a high-level is output for signal HO. When transistor 120 is turned on, a path 210 including the turned-on transistor 120, the resistor 202, and the capacitor 210 is formed so that the current IB11 flows to the base of the upper power switch 402.

In this instance, the current IB11 can be expressed by Equation 1.

$$IB11 = \frac{VB - Vo - VBE1}{RX1} \cdot e^{-\frac{t}{RX1 \cdot C1}} \quad \text{(Equation 1)}$$

Here, the resistance RX1 is the sum of the turn-on resistance of the transistor 120 and the resistance of the resistor 202, and the voltage VBE1 is a threshold voltage of the upper power switch 402. When the transistor 120 is turned on, the current IB11 has its peak value. As time passes, the capacitor 204 is charged, so that the voltage Vc gradually increases. As such, the current IB11 gradually decreases. Accordingly, even when a controller which is designed for MOSFET-implemented power devices is used, the current applied to the bases of the BJT-implemented power switches 402 and 404 is decreased with respect to time. Accordingly, while the power switches 402 and 404 are turned on, the current supplied to the bases is reduced, thus reducing power consumption and preventing heat generation caused by excessive current being applied to the BJT-implemented power switches.

Figure 3:
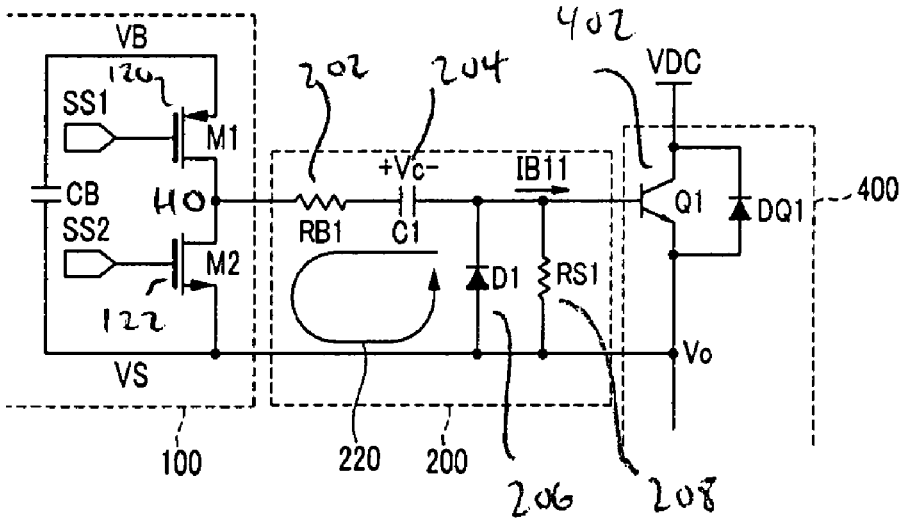
FIG. 3 shows an operation of a portion of the lamp ballast circuit when an upper power switch is turned off, according to an embodiment of the present invention.

FIG. 3 shows an operation of a portion of the lamp ballast circuit 10 when an upper power switch 402 is turned off, according to an embodiment of the present invention. Upper power switch 402 is turned off by an upper driver block 200 in response to control signal HO from control device 102 of controller block 100.

As shown in FIG. 3, when the control signals SS1 and SS2 are high to turn on the transistor 120 and turn off the transistor 122 in the control device 102, a low-level signal is output for signal HO at the pin 7. In this case, the voltage Vc charged in the capacitor 204 is discharged through a discharge path 220 formed by the resistor 202, the turned on transistor 122, and the diode 206. The voltage applied to the base of upper power switch 402 is less than the voltage Vo applied to the emitter. Thus, a negative voltage appears at the base with respect to the emitter. Therefore, the upper power switch 402 is turned off. In this instance, the diode 206 prevents a breakdown between the emitter and base electrodes of the upper power switch 402.

The lower driver block 300, in one embodiment, is operated in a similar manner to that shown and described above with reference to FIGS. 2 and 3 for the upper driver block 200. When a high-level is output from pin 5 of the controller block 100 for signal LO, the current IB12 given by Equation 2 flows to the base of the lower power switch 404.

$$IB12 = \frac{VDD - Vo - VBE2}{RX2} \cdot e^{-\frac{t}{RX2 \cdot C2}} \quad \text{(Equation 2)}$$

In this case, the resistance RX2 is the sum of the resistance of the resistor 302 and an internal random resistance within the controller block 100, and the voltage VBE2 is a threshold voltage of the lower power switch 404.

Also, when a low-level is output from pin 5 for the signal LO, a discharge path is formed (not shown) in which the voltage charged in the capacitor 304 flows to the ground through the resistor 302. Hence, a negative voltage is applied to the base of the lower power switch 404, and the lower power switch 404 is turned off.

Figure 4:
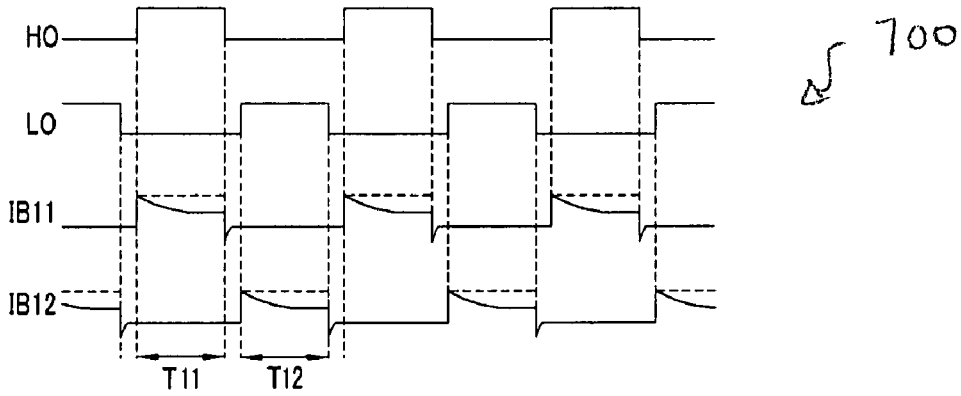
FIG. 4 is a timing diagram of exemplary waveforms, according to an embodiment of the present invention.

FIG. 4 is a timing diagram 700 of exemplary waveforms, according to an embodiment of present invention the. These include waveforms for the signal HO (provided to the upper driver block 200), the signal LO (provided to the lower driver block 300), the current IB11 (flowing to the base of the upper power switch 402), and the current IB12 (flowing to the base of the lower power switch 404).

As shown in FIG. 4, the current IB11 is generated when a high-level is output for signal HO. The high-level of signal HO is maintained for a period of T11. The current IB11 gradually decreases during the period T11. The current IB12 is generated when a high-level is output for signal LO. The high-level of signal LO is maintained for a period of T12. The current IB12 gradually decreases during the period T12.

Figure 5:
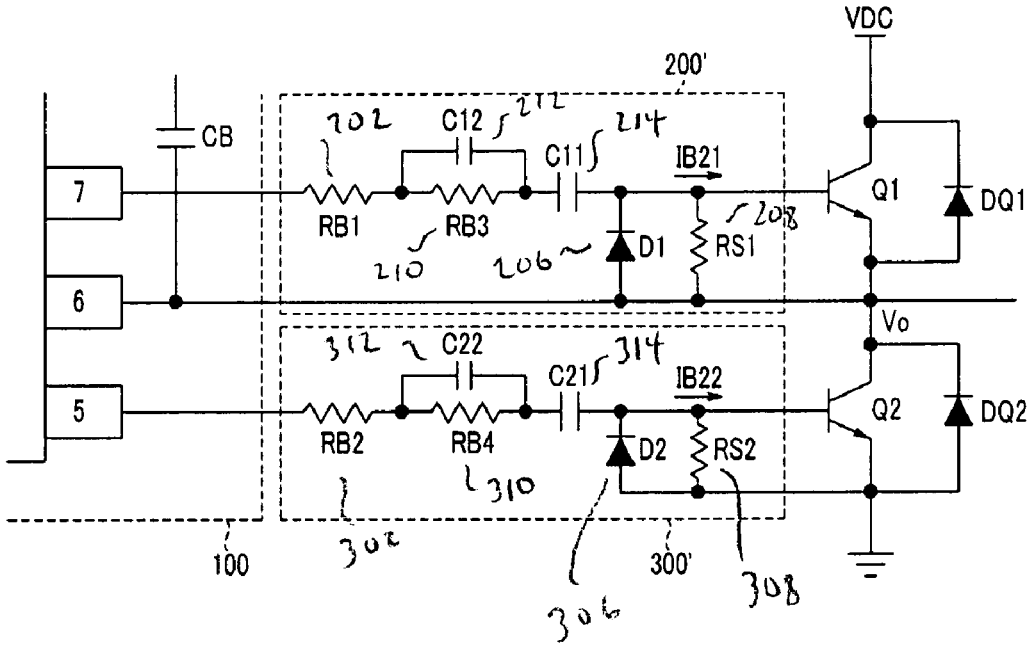
FIG. 5 is a schematic diagram of an exemplary implementation for driver circuitry, according to an embodiment of the present invention.

FIG. 5 is a schematic diagram of another exemplary implementation for driver circuitry, according to an embodiment of the present invention. In particular, FIG. 5 shows an upper driver block 200' and a lower driver block 300' according to an embodiment of the present invention.

The upper driver block 200' shown in FIG. 5 may have some of the same elements as the upper driver block 200 shown in FIG. 1, including resistor 202, diode 206, and resistor 208. In addition, the upper driver 200' further includes a resistor (RB3) 210, a capacitor (C12) 212, and a capacitor (C11) 214. The resistor 210 has a first terminal connected to the resistor 202 and a second terminal connected to a capacitor 214. Capacitor 212 is connected in parallel with the resistor 210. The upper driver block 200' provides a current IB21 to the upper power switch 402.

The lower driver block 300' shown in FIG. 5 may have some of the same elements as the lower driver block 300 shown in FIG. 1, including resistor 302, diode 306, and resistor 308. The lower driver block 300' additionally includes a resistor (RB4) 310, a capacitor (C22) 312, and a capacitor (C21) 314. The resistor 310 has a first terminal connected to the resistor 302 and a second terminal connected to a capacitor 314. The capacitor 312 is connected in parallel with the resistor 310. The lower driver block 300' provides a current IB22 to the lower power switch 404.

In a lamp ballast circuit using the upper driver block 200' and the lower driver block 300' shown in FIG. 5, due to the resistor 210 and the resistor 310, the current IB21 and the current IB22 are reduced more steeply than current IB11 and current IB12 in the upper driver block 200 and lower driver block 300 shown in FIG. 1.

In particular, for the upper driver block 200', the rising edge of the signal HO may contain many high frequency components when the signal HO changes from low to high level, so the impedance of the capacitor 212 is substantially less than the resistor 210. Therefore, when a high-level is output for signal HO, the current IB21 flows through the path formed by the resistor 202, the capacitor 212, and the capacitor 214. When the high frequency components of the signal HO are reduced as time passes, the impedance of the capacitor 212 increases. The current flowing through the resistor 210 increases so that the current IB21 is steeply reduced. When a low-level is output for signal HO, a negative voltage is applied to the base of the upper power switch 402, and so the upper power switch 402 is turned off according to the voltage charged in the capacitor C11, in a like manner to that of the upper driver block 200 of FIG. 1.

The lower driver block 300' is operated in a like manner as the upper driver block 200'. The resistor 310 and the capacitor 312 of the lower driver block 300' perform substantially the same functions as the resistor 210 and the capacitor 212 of the upper driver block 200'.

Figure 6:
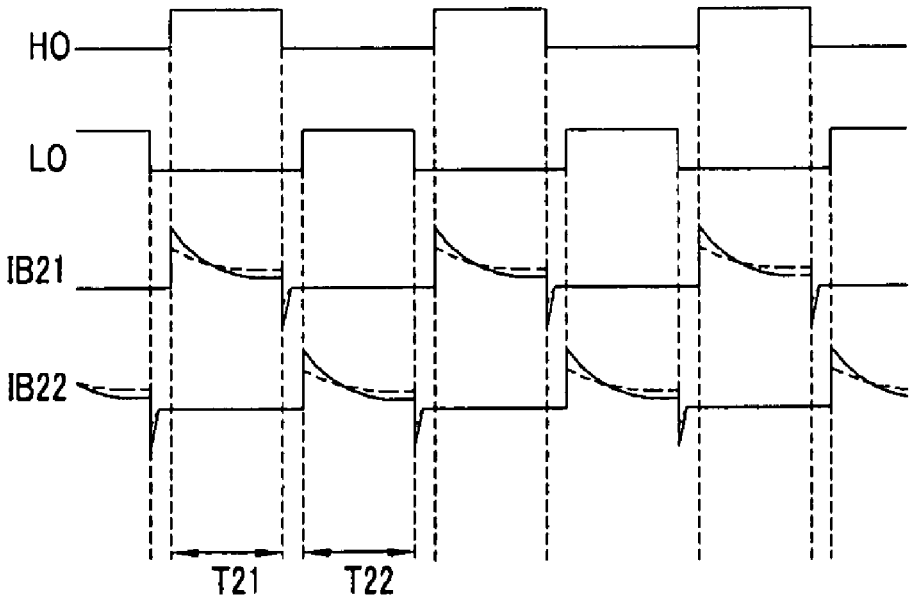
FIG. 6 is a timing diagram of exemplary waveforms, according to an embodiment of the present invention.

FIG. 6 is a timing diagram 800 of exemplary waveforms, according to an embodiment of the present invention. These include waveforms for the signal HO (provided to the upper driver block 200'), the signal LO (provided to the lower driver block 300'), the current IB21 (flowing to the base of the upper power switch 402), and the current IB22 (flowing to the base of the lower power switch 404).

FIG. 6 shows the waveforms for the currents IB21 and IB22 of upper and lower driver blocks 200' and 300' superimposed over the waveforms for the currents IB11 and IB12 of upper and lower driver blocks 200 and 300. The current waveforms shown as solid lines are waveforms of the currents IB21 and IB22, whereas the current waveforms illustrated by the dotted lines are waveforms of the currents IB11 and IB12. As shown, the currents IB21 and IB22 overlap the currents IB11 and IB12.

As shown in FIG. 6, the current IB21 is generated when a high-level is output for signal HO. The high-level of signal HO is maintained for a period of T21. The current IB21 decreases during the period T21. FIG. 6 shows that the magnitude of current IB21 decreases more rapidly that that of the current IB11 during the period T21. The current IB22 is generated when a high-level is output for signal LO. The high-level of signal LO is maintained for a period of T22. The current IB22 decreases during the period T22. FIG. 6 shows that the magnitude of current IB22 decreases more rapidly that that of the current IB12 during the period T22.

Accordingly, the lamp ballast circuit implemented with upper and lower driver blocks 200' and 300' can reduce power consumption and the heat generated from the power switches.

According to embodiments of the present invention, a lamp ballast circuit is provided that can lower production cost, reduce power consumption, and prevent heat generation by using one or more BJT-implemented power elements.

Although the present invention and its advantages have been described in detail, it should be understood that various changes, substitutions, and alterations can be made therein without departing from the spirit and scope of the definition as defined by the appended claims. That is, the discussion included in this application is intended to serve as a basic description. It should be understood that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Neither the description nor the terminology is intended to limit the scope of the claims.

What is claimed is:

1. A lamp ballast circuit comprising:

a first power switch, including a first terminal coupled to a first power source;

a first driver circuitry for controlling the first power switch; and a controller including a first output terminal for outputting a control signal to the first driver circuitry;

wherein the first driver circuitry includes a first capacitor having a first terminal electrically connected to a control electrode of the first power switch and a second terminal electrically connected to the first output terminal;

a first resistor connected to the second terminal of the first capacitor and the first output terminal; and a second resistor connected between the first terminal of the first capacitor and a second terminal of the first power switch.

2. The lamp ballast circuit of claim 1, wherein the first power switch comprises a bipolar junction transistor.

3. The lamp ballast circuit of claim 2, wherein the controller is designed to be used with a power switch implemented as a MOSFET.

4. The lamp ballast circuit of claim 2, comprising a diode connected in parallel to the second resistor.

5. The lamp ballast circuit of claim 4, comprising:

a third resistor having a first terminal connected to the first resistor and a second terminal connected to the second terminal of the first capacitor; and a second capacitor connected in parallel to the third resistor.

6. The lamp ballast circuit of claim 1, comprising:

a second power switch having a first terminal connected to the second terminal of the first power switch, a first terminal of the first power switch being connected to a first power source; and a second driver circuitry for controlling the second power switch, wherein the controller includes a second output terminal for outputting a control signal to the second driver circuitry, and the second driver circuitry includes a second capacitor having a first terminal electrically connected to a control electrode of the second power switch and a second terminal electrically connected to the second output terminal.

7. The lamp ballast circuit of claim 6, wherein the second power switch is a bipolar junction transistor.

8. The lamp ballast circuit of claim 7, wherein the second driver includes:

a first resistor connected to the second terminal of the second capacitor and the second output terminal; and a second resistor connected between the first terminal of the second capacitor and an emitter electrode of the bipolar junction transistor.

9. The lamp ballast circuit of claim 7, further comprising a diode connected in parallel to the second resistor.

10. The lamp ballast circuit of claim 9, comprising:

a third resistor having a first terminal connected to the first resistor and a second terminal connected to the second terminal of the second capacitor; and a third capacitor connected in parallel to the second resistor.

11. A lamp ballast circuit comprising:

a power switch;

a driver circuitry for generating a drive current signal for controlling the switching operation of the power switch; and a controller for generating a control signal that has a level for turning on the power switch for a first period, the controller providing the control signal to the driver circuitry, wherein the drive current signal reaches a maximum value at a beginning of the first period, the value of the drive current signal decreasing during the first period;

wherein the driver circuitry includes:

a first resistor for receiving the control signal through a first terminal; and a first capacitor having a first terminal connected to a second terminal of the first resistor, and a second terminal connected to a control electrode of the power switch, wherein the first resistor and the first capacitor reduce the drive current signal as time passes.

12. The lamp ballast circuit of claim 11, wherein the driver circuitry includes:

a second resistor having a first terminal connected to a node where the first capacitor and the control electrode are connected, and a second terminal connected to a first electrode of the power switch; and a diode connected in parallel to the second resistor.

13. The lamp ballast circuit of claim 12, comprising:

a third resistor having a first terminal connected to the first resistor and a second terminal connected to the first terminal of the first capacitor; and a second capacitor connected in parallel to the third resistor.

14. The lamp ballast circuit of claim 11, wherein the power switch comprises a bipolar junction transistor.

15. The lamp ballast circuit of claim 14, wherein the controller is designed to be used with a power switch implemented as a MOSFET.

16. A lamp ballast circuit comprising:

a first power switch operable to be turned on and off for providing power to a lamp, the first power switch having a control electrode;

a first driver circuitry for driving the first power switch with a current provided at the control electrode; and a controller including a first output terminal for outputting a control signal to the first driver circuitry to control the driving of the first power switch;

wherein the first driver circuitry includes a first capacitor having a first terminal electrically connected to the control electrode of the first power switch and a second terminal electrically connected to the first output terminal, wherein the first capacitor causes a magnitude of the current provided at the control electrode to decrease over a period following the turn on of the first power switch.

17. The lamp ballast circuit of claim 16, wherein the first power switch is a bipolar junction transistor.

18. The lamp ballast circuit of claim 16, wherein the controller is designed to be used with a power switch implemented as a MOSFET.

19. The lamp ballast circuit of claim 16, wherein the controller is implemented as an integrated circuit device.

* * * * *